US007197866B2

(12) United States Patent
Cook et al.

(10) Patent No.: US 7,197,866 B2
(45) Date of Patent: Apr. 3, 2007

(54) CONTROL APPROACH FOR USE WITH DUAL MODE OXYGEN SENSOR

(75) Inventors: Jeffrey A. Cook, Dearborn, MI (US); Richard E. Soltis, Saline, MI (US); Alex D. Colvin, Oak Park, MI (US); Jessy Grizzle, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 226 days.

(21) Appl. No.: 10/705,436

(22) Filed: Nov. 10, 2003

(65) Prior Publication Data

US 2004/0098967 A1 May 27, 2004

(51) Int. Cl.
*F01N 3/00* (2006.01)

(52) U.S. Cl. ..... 60/285; 60/274; 60/276; 73/23.32; 73/118.1; 204/424

(58) Field of Classification Search ..... 60/274, 60/276, 277, 285; 73/23.31, 23.32, 118.1; 204/424; 205/784.5
See application file for complete search history.

(56) References Cited

U.S. PATENT DOCUMENTS 5,077,970 A 1/1992 Hamburg
5,255,512 A 10/1993 Hamburg et al.
5,282,360 A 2/1994 Hamburg et al.
5,293,740 A 3/1994 Happner et al.
5,319,921 A * 6/1994 Gopp ..... 60/274
5,341,643 A 8/1994 Hamburg et al.
5,413,683 A 5/1995 Murase et al.
5,474,665 A 12/1995 Friese et al.
5,842,340 A * 12/1998 Bush et al. ..... 60/274
5,972,200 A 10/1999 Kim
6,018,945 A 2/2000 Nakagawa
6,067,794 A * 5/2000 Simon et al. ..... 60/285
6,116,021 A * 9/2000 Schumacher et al. ..... 60/274
6,256,983 B1 * 7/2001 Yasui ..... 60/285
6,637,194 B2 * 10/2003 Kakuyama et al. ..... 60/285
2001/0052473 A1 12/2001 Ohkuma
2005/0133381 A1 * 6/2005 Kerns et al. ..... 205/784.5

* cited by examiner

*Primary Examiner*—Tu M. Nguyen
(74) *Attorney, Agent, or Firm*—Allan J. Lippa; Alleman Hall McCoy Russell & Tuttle LLP

(57) ABSTRACT

Electronic circuitry and control algorithms are described to automatically establish the output voltage of a linear exhaust gas oxygen sensor (e.g., a UEGO sensor) corresponding to an exhaust air-fuel ratio of stoichiometry. The apparatus and control logic herein described may be used to adaptively correct the setpoint of an air-fuel ratio control system in which a UEGO sensor is used in a feedback loop to adjust the fuel injection quantity of an internal combustion engine.

18 Claims, 9 Drawing Sheets

CONTROL APPROACH FOR USE WITH DUAL MODE OXYGEN SENSOR

TECHNICAL FIELD

The field of the invention relates to an exhaust gas oxygen sensor used in engines of mobile vehicles to reduce emissions during a wide range of operating conditions using a sensor providing both a switching signal and a linear signal indicative of exhaust air-fuel ratio.

BACKGROUND AND SUMMARY OF THE INVENTION

Engine exhaust systems utilize sensors to detect operating conditions and adjust engine air-fuel ratio. One type of sensor used is a switching type heated exhaust gas oxygen sensor (HEGO). The HEGO sensor provides a high gain between measured oxygen concentration and voltage output. That is, the output of the HEGO sensor is very close to being a step change in voltage at stoichiometry. Hence, the HEGO sensor can provide an accurate indication of the stoichiometric point, but provides air/fuel information over an extremely limited range. For HEGO sensors located upstream of the catalytic converter, the location of the characteristic step change may shift from stoichiometry as a result of system characteristics such as incomplete exhaust gas mixing.

Another type of sensor used is a universal exhaust gas oxygen sensor (UEGO). The substantially linear relationship between the sensor output voltage and exhaust gas oxygen concentration allows the sensor to operate across a wide range of air-fuel ratios, and therefore can provide advantageous information when operating away from stoichiometry. However, as recognized by the inventors herein, the UEGO sensor may not provide an indication of stoichiometry as precise as the HEGO sensor without the binary output of a HEGO to accurately locate the desired air-fuel ratio. For UEGO sensors located upstream of the catalytic converter, errors in perceived air-fuel ratio may occur as a result of system characteristics such as incomplete exhaust gas mixing. Furthermore, small variations in the output characteristic from sensor-to-sensor, or changes in the sensor characteristic with age or operating point, may cause a deterioration in the emissions performance of the system. Further, a typical UEGO calibration can have variance that is higher than desired for improved control results. Finally, the sensor's calibration may drift over time, degrading performance.

Several closed-loop air-fuel ratio control systems are known that utilize sensors upstream and downstream of a three-way catalytic converter (TWC) for controlling engine air-fuel ratio operation. Such systems may include various combinations of upstream and downstream sensors. In some approaches, upstream and downstream sensors are used to regulate the amount of oxygen stored in the TWC (see U.S. Pat. No. 6,502,389, for example). Regardless of the approach, a feedback signal on engine A/F is typically derived from the upstream sensor. The sensor downstream of the catalytic converter, considered to be unbiased, generates a signal used to correct the upstream sensor signal and maintain high efficiency catalyst operation. However, the inventors herein have recognized that a fundamental property of such systems is that if the aft sensor is miscalibrated, then it may not be possible to correct errors on the upstream sensor.

The inventors herein further have recognized that when an oxygen sensor is used in an exhaust gas system of an engine operating at a wide variety of conditions, the precise indication of stoichiometry given by the HEGO sensor provides advantageous results. In particular, conventional methods of correcting the setpoint of a pre-catalyst (UEGO or HEGO) sensor using a post-catalyst HEGO or UEGO sensor can require substantial calibration, and do not necessarily locate the setpoint of the upstream sensor at the highest possible conversion point of the catalyst.

To overcome these disadvantages, and harness the advantages of both types of sensors, the following approach can be utilized to calibrate a UEGO sensor against a HEGO sensor. In the absence of a chemical bias, for example in the case of a sensor located aft of a catalytic converter, this can yield a stoichiometric or other calibratible set-point.

Specifically, in one aspect, a method for controlling fuel injection into an engine having an exhaust system with an emission control device located therein is used. The method comprises:

reading information from a downstream sensor coupled in said emission control system downstream of said emission control device, said information including a substantially linear indication of exhaust air-fuel ratio across a range of air-fuel ratios from at least 12:1 to 18:1, said information also including a substantially non-linear indication of stoichiometry;

adjusting a setpoint for an upstream sensor based on said signal; and adjusting fuel injection into the engine based on said adjusted setpoint and a signal from said upstream sensor.

In this way, it is possible to automatically establish a sensor setpoint (for example a setpoint corresponding to stoichiometry), even when using a sensor that provides a wide range air-fuel ratio sensing ability. Further, it is possible to determine a setpoint for an upstream sensor that accurately locates the point of maximum conversion efficiency with reduced calibration.

Also, since this example uses a method of extracting both switching and linear signals from a single sensor, it is possible to enable the identification of a UEGO sensor setpoint corresponding to stoichiometry without requiring a separate HEGO sensor.

An advantage of the above aspect is to obtain high catalytic converter efficiency despite sensor-to-sensor variability or changes in the sensor characteristics over time by adjusting the control setpoint during normal engine operation.

BRIEF DESCRIPTION OF THE DRAWINGS

The advantages described herein will be more fully understood by reading example embodiments in which the invention is used to advantage, referred to herein as the Description of Embodiment(s), in which like reference numbers indicate like features, with reference to the drawings wherein.

DESCRIPTION OF EMBODIMENT(S)OF THE INVENTION

The present application relates generally to a system for maintaining engine air-fuel ratio (A/F) operation within, or near, the peak efficiency window of a catalytic converter. However, the control methods and approaches herein can be used generally for air-fuel ratio control at various air-fuel ratios, even outside the peak efficiency window.

Also in this application, electronic circuitry and control algorithms are described to automatically calibrate the setpoint of a downstream UEGO sensor to correspond to the air-fuel ratio identified by the switchpoint of a HEGO sensor with a calibratible bias. In one embodiment, the generated setpoint corresponds to the switchpoint of a post-catalyst HEGO sensor with a calibratible rich bias to assure high NOx efficiency. Alternatively, the setpoint of an upstream UEGO sensor may be automatically calibrated to correspond to the air-fuel ratio identified by the switchpoint of an upstream HEGO sensor with a calibratible bias.

Figure 1:
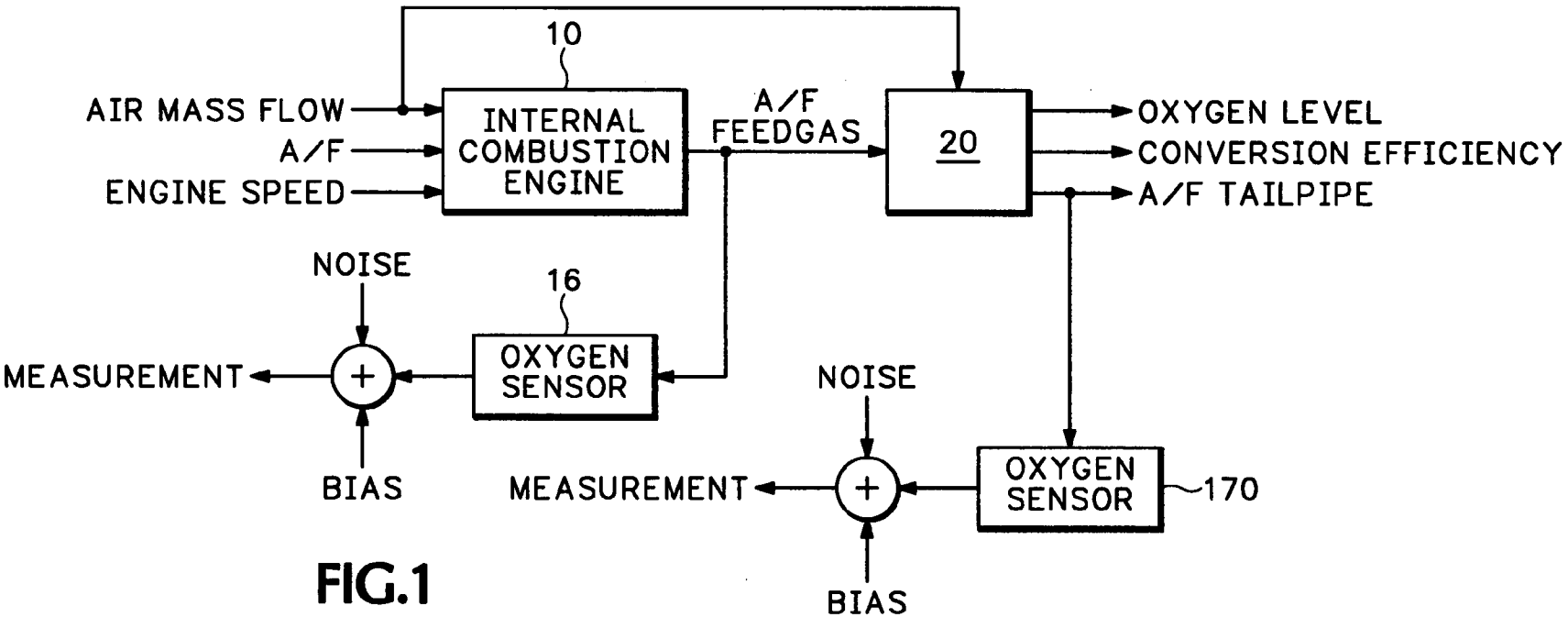
FIG. 1 illustrates a typical structure of a system using multiple oxygen sensors.

Referring now to FIG. 1, a block diagram of a control system is descried. Note that FIG. 1 shows a schematic representation of an example system. Internal combustion engine 10 is shown schematically receiving an air mass flow, and air-fuel ratio, and an engine speed. The engine 10 outputs a feedgas air-fuel ratio sensed by upstream oxygen sensor 16. The feedgas is shown entering emission control device 20, which outputs an oxygen level, a conversion efficiency, and a tailpipe air-fuel ratio. The tailpipe air-fuel ratio is sensed by oxygen sensor 170. FIG. 1 shows how noise and bias are introduced into the sensor measurements by linear addition, to provide the final measurement.

Figure 2:
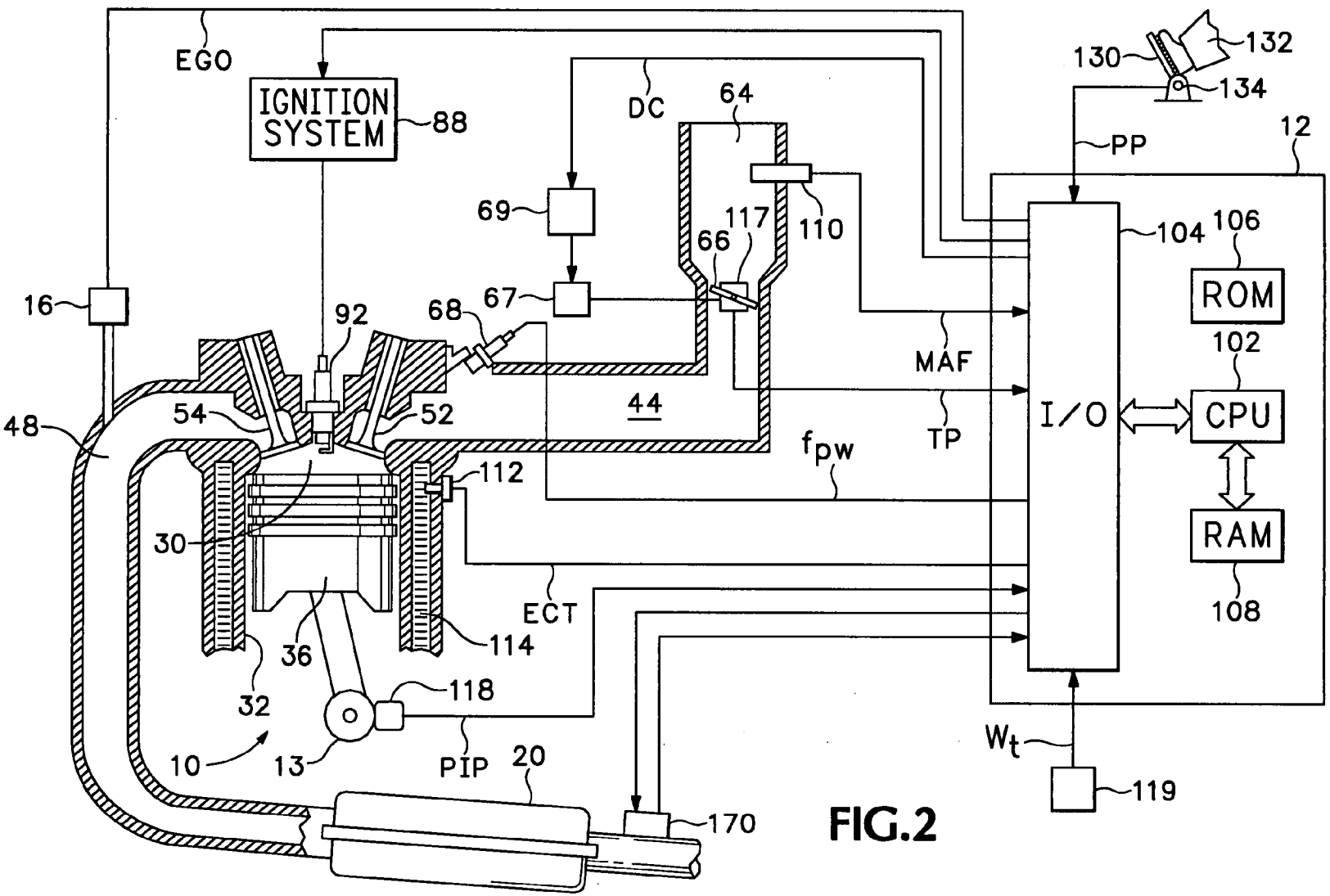
FIG. 2 is a block diagram of an engine and exhaust system.

Referring now to FIG. 2, one cylinder of a multi-cylinder engine is shown. The engine can be a 4 or 6 cylinder inline engine, v-type engine (6, 8, 10, or 12 cylinders, for example), or any other suitable type. In the embodiment illustrated in FIG. 2, the engine is presumed to incorporate an electronically actuated throttle, but the invention described herein is equally applicable to engines with conventionally operated throttles operated via mechanical linkage to the accelerator pedal, which include an idle air bypass valve. Electronic engine controller 12 is shown controlling internal combustion engine 10. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20. Sensor 16 can be various types of sensors, such as an unheated exhaust gas oxygen sensor (EGO), HEGO, or UEGO, as described in more detail below. Further, a second exhaust gas sensor 170 is also shown communicating with controller 12. The UEGO sensor can provide a substantially linear indication of exhaust air-fuel ratio across a range of air-fuel ratios from at least 12:1 to 18:1, or 11:1 to 20:1, or various other ranges and subranges.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of turbine speed (Wt) from turbine speed sensor 119, where turbine speed measures the speed of shaft 17, and a profile ignition pickup signal (PIP) from Hall effect sensor 118 coupled to crankshaft 13 indicating and engine speed (N).

Continuing with FIG. 2, accelerator pedal 130 is shown communicating with the driver's foot 132. Accelerator pedal position (PP) is measured by pedal position sensor 134 and sent to controller 12.

As will be appreciated by one of ordinary skill in the art, the specific routines described below in the flowcharts may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the invention, but is provided for ease of illustration and description. Although not explicitly illustrated, one of ordinary skill in the art will recognize that one or more of the illustrated steps or functions may be repeatedly performed depending on the particular strategy being used. Further, these Figures graphically represent code to be programmed into the computer readable storage medium in controller 12.

The exhaust gas sensors 16 and 170 may comprise linear sensors (generally referred to as "universal exhaust gas oxygen" or UEGO sensors); nonlinear or switching sensors (generally referred to as "heated exhaust gas oxygen" or HEGO sensors); or some combination of linear and nonlinear sensors. Further, as described in more detail below, the downstream sensor 170, includes additional circuitry so that two signals are provided, one being a UEGO type signal, and the other being a HEGO type signal. These can both be provided on a single signal line, or with multiple signal lines. Also, controller 12 can send a signal to sensor 170 to control what type of signal is produced.

In one example, emission control device 20 is a catalytic converter with a narrow A/F range near stoichiometry over which high conversion efficiencies can be achieved for HC, CO and NOx.

In general terms, controller 12 adjusts engine air-fuel ratio via adjusting fuel injection. As will be appreciated by one of ordinary skill in the art, air-fuel ratio may be adjusted by methods other than by adjusting fuel flow. For example, air-fuel ratio may be adjusted by modifying airflow as described in U.S. Pat. No. 5,377,654. Such alternative methods may be substituted without loss of generality for the fuel control subsequently described. Referring to controller 12, the adjustment is derived from a feedback signal from the upstream sensor. However, information from the downstream sensor is also utilized, in that the control setpoint of the pre-catalyst UEGO or HEGO sensor is adjusted to more accurately align the commanded A/F with stoichiometry as determined by a post-catalyst sensor signal.

As described above, FIG. 2 shows a typical configuration consisting of a catalytic converter with pre- and post-catalyst air-fuel ratio sensors. Also, as indicated, the pre-catalyst sensor may be either a UEGO sensor, a HEGO sensor, or a combined UEGO-HEGO sensor as described below. Furthermore, the catalytic converter may be any of numerous configurations employed in the aftertreatment system of an internal combustion engine. For example, the catalyst may refer to the first, second or subsequent brick in a multiple catalyst system, or the sensors referred to in this disclosure may bracket multiple bricks in such a system. In the example described in more detail below, the post-catalyst sensor is a combined UEGO-HEGO sensor. Alternative configurations may easily be derived.

Figure 3:
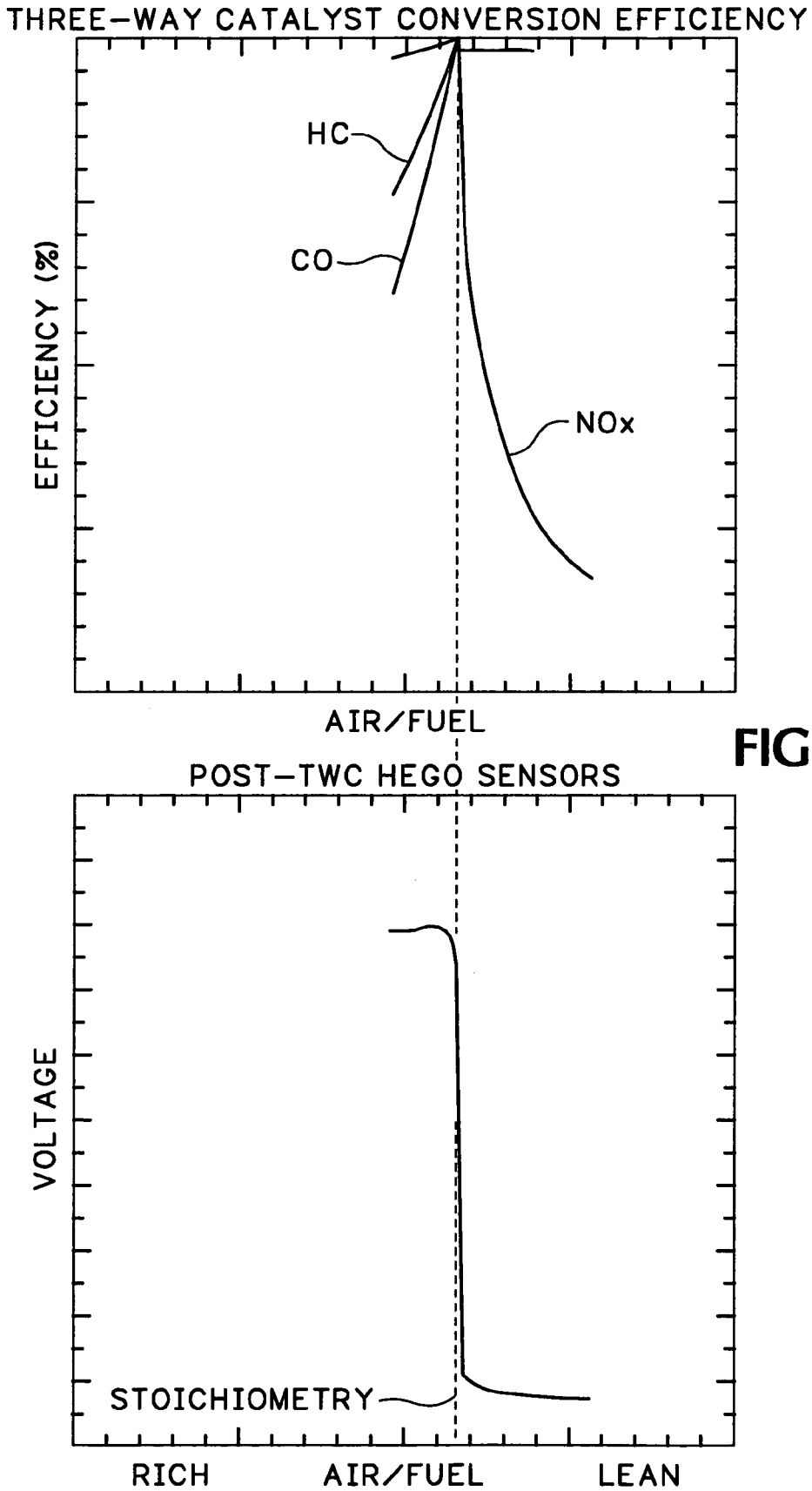
FIG. 3 shows the relationship between the signal from a post-catalyst HEGO sensor and the maximum simultaneous conversion efficiency of a three-way catalytic converter.

FIG. 3 shows the relationship between a signal from a post-catalyst HEGO sensor and the maximum simultaneous conversion efficiency of a catalytic converter, and illustrates that the lowest emissions may be obtained by regulating the air-fuel ratio of an internal combustion engine about the switch point of the post-catalyst HEGO. It may be appreciated that for purposes of robustness and to assure high NOx efficiency, it may be desirable to bias the control point of the air-fuel ratio control system slightly rich of stoichiometry, or slightly lean, depending on engine operating conditions.

In prior art systems where a downstream HEGO sensor is used to correct the setpoint of an upstream sensor, a feedback loop is employed to achieve a calibrated voltage on the post-catalyst sensor, usually 0.6 volts. This feedback loop, in general, can be carefully gain-scheduled over the operating range of the engine. The high sensitivity of the post-catalyst HEGO sensor usually means that small deviations in the controlled voltage result in large changes in air-fuel ratio and correspondingly large reductions in catalyst efficiency. To overcome this disadvantage, in one example, the UEGO signal from a downstream air-fuel sensor is used to provide adjustment to the upstream setpoint and thereby obtain improved performance.

Figure 4A:
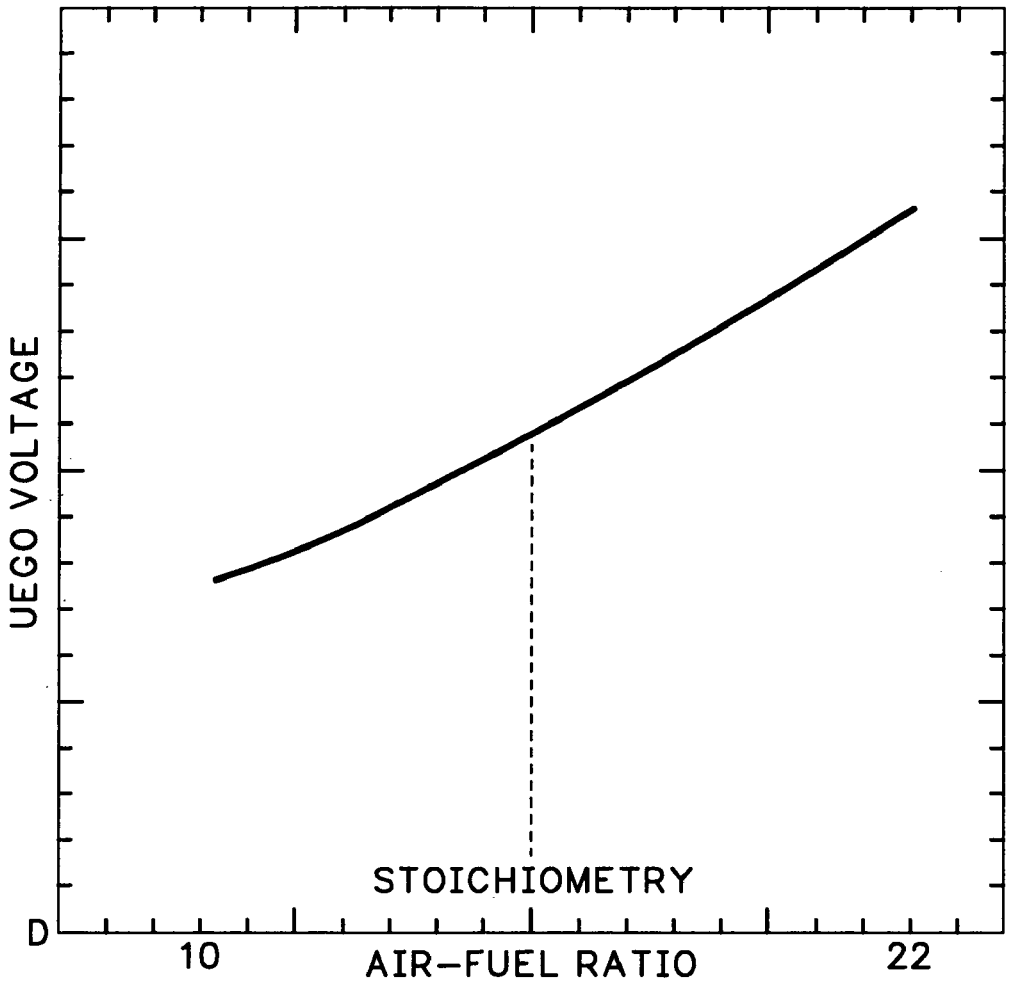
FIGS. 4A and 4B show exemplary output signals from example UEGO sensors.
Figure 4B:
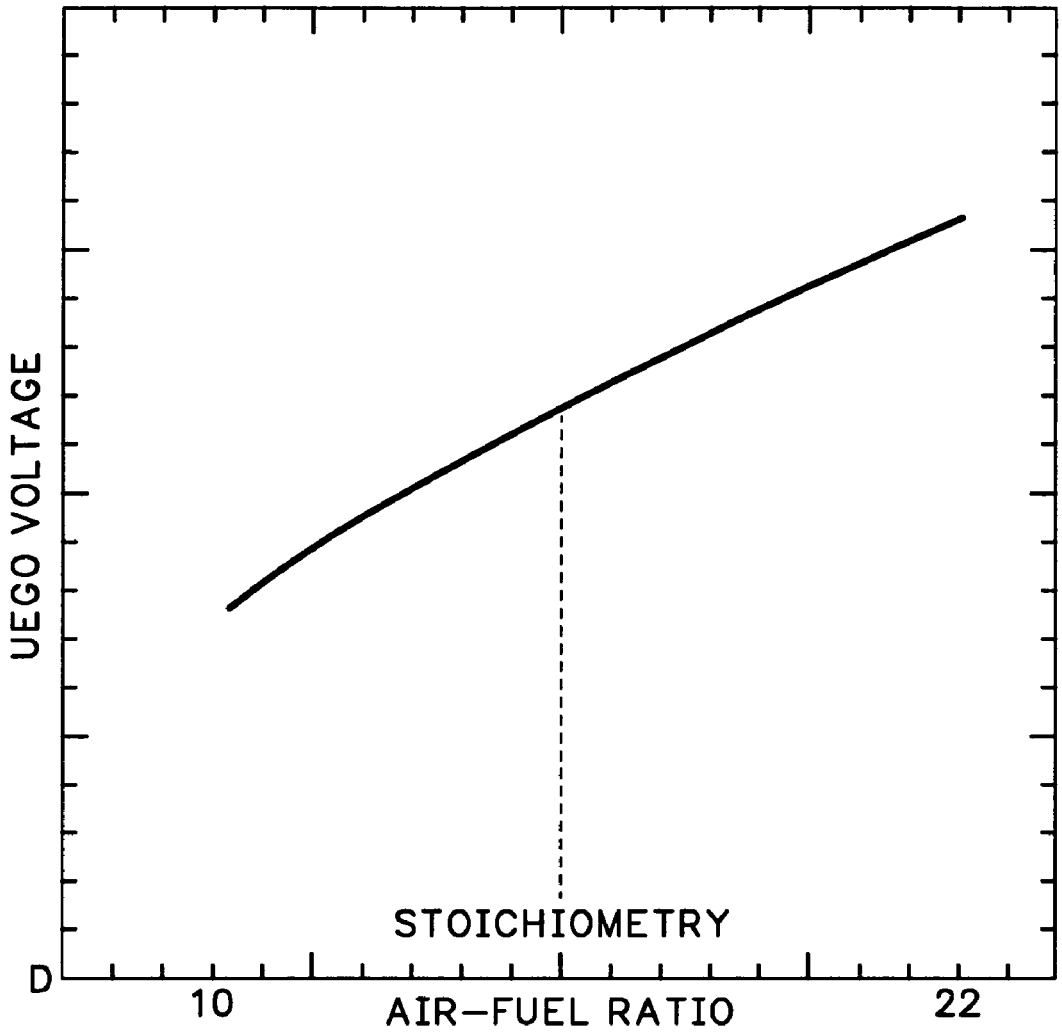

FIG. 4 shows the typical output signal from a UEGO sensor. As described above, a disadvantage with prior approaches using a downstream UEGO sensor is that without the binary output of a HEGO to accurately locate the desired air-fuel ratio, the selection of the control setpoint for a feedback control loop employing a UEGO sensor is problematic, and small variations in the output characteristic from sensor-to-sensor, or changes in the sensor characteristic with age or operating point may cause a deterioration in the emissions performance of the system.

As described below herein, electronic circuitry and control algorithms are described to automatically calibrate the setpoint of the UEGO sensor to correspond to the air-fuel ratio identified by the switchpoint of a HEGO sensor with a calibratible bias. In one embodiment, the generated setpoint corresponds to the switchpoint of a post-catalyst HEGO sensor with a calibratible rich bias to assure high NOx efficiency.

Figure 5:
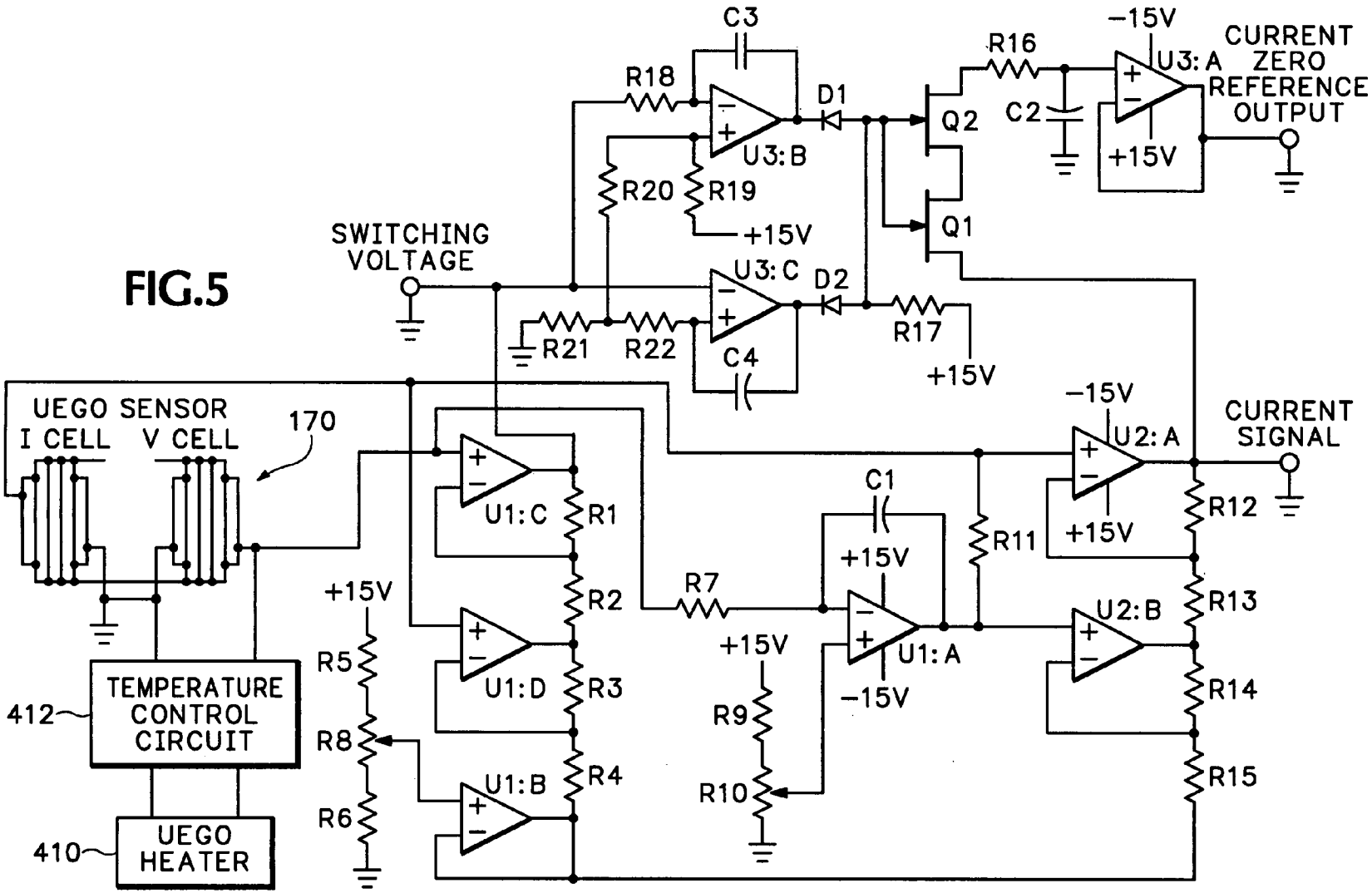
FIG. 5 is a diagram of an electrical circuit that (a.) determines when the exhaust gas is at stoichiometry by measuring the difference between the air and exhaust gas electrodes in a conventional UEGO sensor and (b.) samples and holds the output voltage of the UEGO sensor at stoichiometry for use as a reference voltage in an air-fuel ratio feedback control loop.

FIG. 5 is a diagram of an electrical circuit that extracts a measurement of the sensor voltage corresponding to stoichiometry (i.e., the switchpoint voltage of a conventional HEGO sensor) from a UEGO sensor, captures the associated UEGO sensor voltage, and makes this value available to update the setpoint of the feedback control system regulating air-fuel ratio in an internal combustion engine. If the sensor is located in the exhaust stream after the catalytic converter, the determined voltage corresponds to the stoichiometric air-fuel ratio. As illustrated in FIG. 3, in one example, this is the maximum conversion point of the catalyst.

The circuit can be coupled to the exhaust sensor 170, or located in controller 12. It may further be appreciated that the logical operations implemented in the electronic circuits illustrated in FIGS. 5 and 6 and described below may be otherwise implemented to equal advantage. For example, some operations may be instantiated in software located in microprocessor memory.

Continuing with FIG. 5, the circuit diagram follows standardized labeling. Specifically, capacitors are labeled starting from C1 to C4, with capacitance indicated. Resistors are indicated as R1 through R21, with resistance indicated. Likewise, the triangles labeled starting with a U represent amplifiers. The grounds are indicated via the label GRD. UEGO sensor 170 is also shown on the diagram indicating the connection to the circuit, as well as temperature controller 410 coupled to the heater 412. Voltage sources/references are indicated via a line with the voltage level as labeled. Finally, transistors are indicated as Q1 and Q2 and Diodes are indicated as D1 through D2. Wires (with colors) are also indicated.

A detailed explanation of the circuit is described below.

A. Amplifier U1A compares the voltage of the voltage cell of the UEGO (Universal Exhaust Gas Oxygen sensor) to a bias setting of 0.45 V and produces a current going to the current cell of the UEGO to maintain the voltage cell at 0.45 Volts.

B. Amplifiers U2A and U2B find twice the difference voltage across the current sampling Resistor R11 and adds it to 3.00 volts generated in amplifier U1B. This is the UEGO signal conventionally read by the microprocessor and used to regulate air-fuel ratio.

C. Amplifier U1D and Amplifier U1C together find the difference between the voltage on the electrode in the exhaust and the voltage on the electrode that is in air. This is the switching voltage that a HEGO (Heated Exhaust Gas Oxygen sensor) would produce at stoichiometry.

D. The 3.00 volts produced by amplifier U1B mentioned in (2) above are also added to the switching voltage mentioned in 3 to generate a positive signal to be read by the microprocessor.

E. Amplifiers U3B and U3C are used as comparators to operate the switch (made up of Q1 and Q2) so as to sample the current signal voltage mentioned in (2) when the switching voltage mentioned in (3) is between 3.8 and 4.0 volts (equivalent to an operating bias of 0.40 to 0.50 volts for the UEGO). We consider a bias near 0.45 volts indicates stoichiometry.

Figure 6:
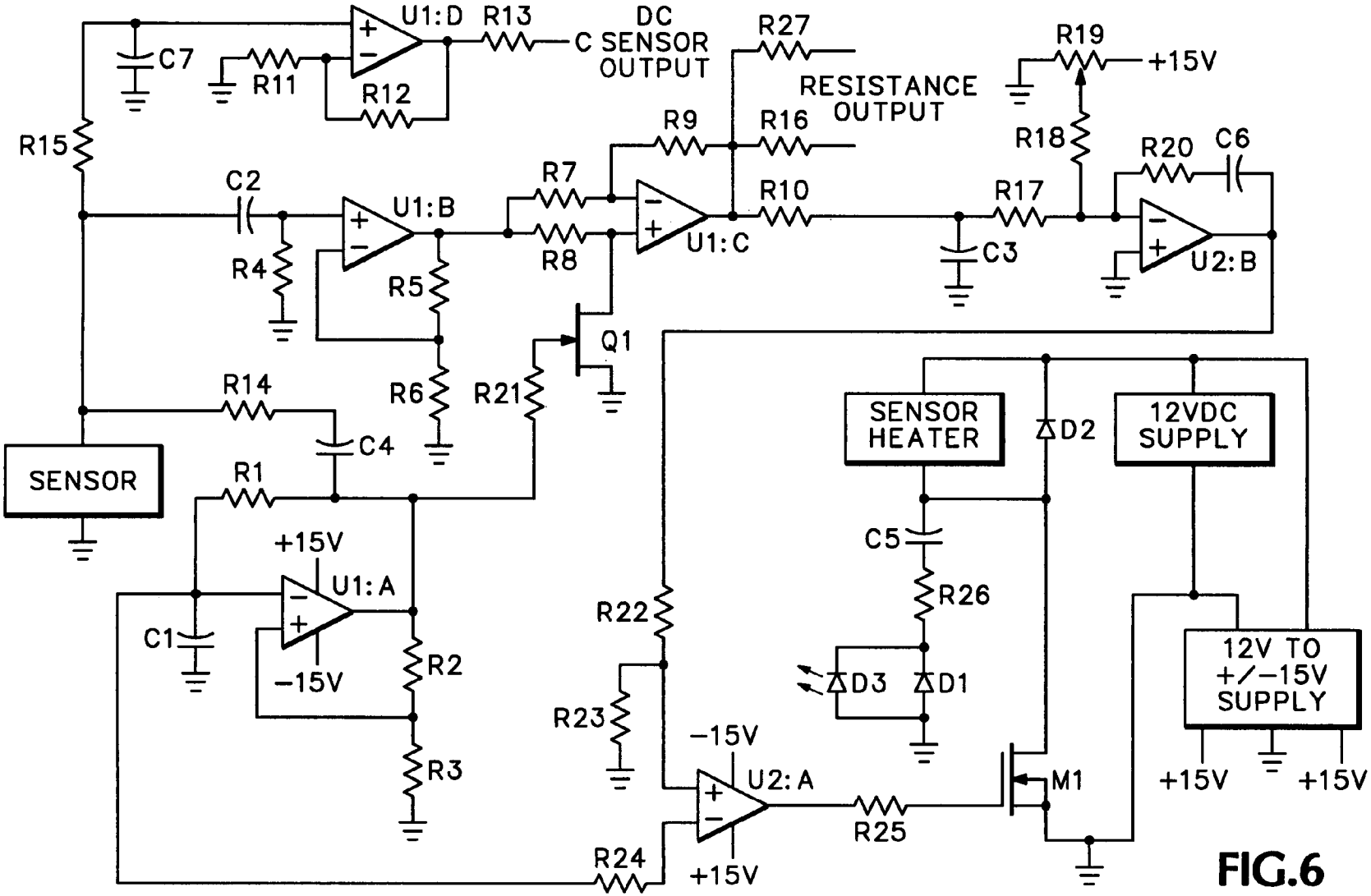
FIG. 6 is a circuit diagram of a heater circuit appropriate for the operation of the sensor and circuitry described in FIG. 5.

F. Amplifier U3A saves the current signal voltage of the UEGO at the time when the exhaust is going through stoichiometry. This voltage is available as an input signal to the air-fuel ratio control system, providing an accurate reference value at stoichiometry. FIG. 6 is a schematic diagram describing the voltages described in (C) and (E) above, which follows the same labeling convention as in FIG. 5.

Note that in steps (A) and (F) above, the reference voltage may be a voltage other than 0.45 volts so as to impose a bias on the reference signal for the air-fuel ratio control system. Typically, a voltage of 0.6 provides a slight rich bias to assure operation in the high NOx conversion efficiency regime of the three-way catalytic converter. Alternatively, a reference voltage of 0.45 establishes the sensor output corresponding to stoichiometry, to which a calibratible bias may be added by the controller logic described in a subsequent section of the disclosure.

FIG. 6 is a diagram of the temperature control circuit used in conjunction with the voltage measuring circuit shown in FIG. 5. A 1 KHZ square wave voltage is generated in amplifier U1A. This voltage produces a current of about +/−150 microamps through R14 which flows into the voltage cell of the UEGO (Universal Exhaust Gas Oxygen sensor). The square wave voltage produced across the voltage cell is amplified 20 times in amplifier U1B and synchronously detected in amplifier U1C. The output of the synchronous detector is proportional to the resistance of the cell which varies inversely with the control temperature of the sensor.

The measured resistance signal is compared with a reference resistance signal and the result goes to amplifier U2B whose output is transformed into a pulse width modulated output in amplifier U2A using a 5 volt triangle wave generated in amplifier U1A at pin 2. This output drives the FET M1 which turns the heater voltage of the UEGO, on and off to control the sensor temperature.

Figure 7:
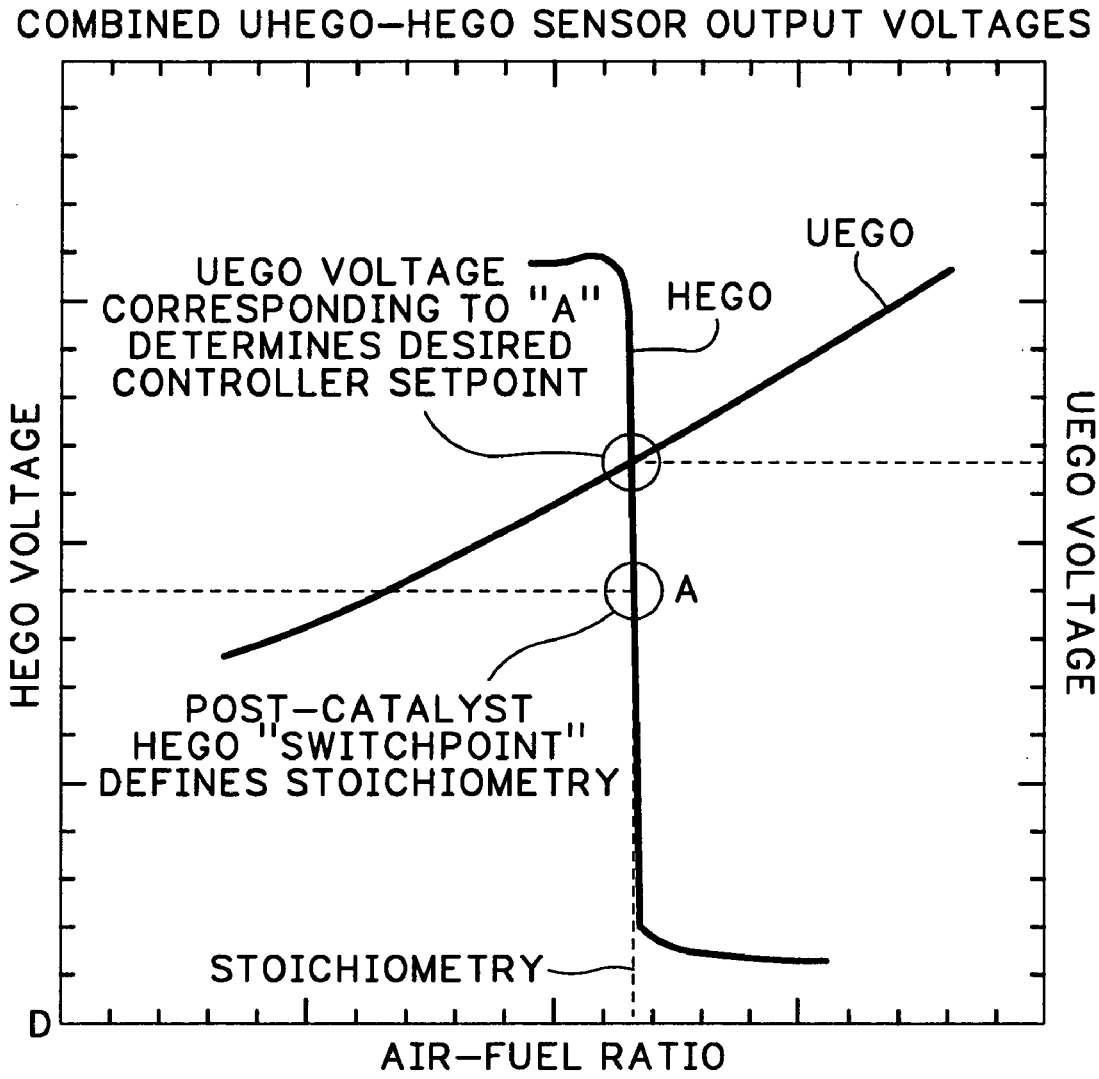
FIG. 7 is a schematic diagram of the relationship between the signals extracted from the UEGO sensor by the circuit described by FIG. 5.

Referring now to FIG. 7, a graph is shown illustrating substantially linear, and substantially non-linear, output signals, as a function of air-fuel ratio. As illustrated, in one embodiment, the voltage of the substantially linear signal corresponding to the switching point of the non-linear signal is identified and used to adjust fuel injection.

Figure 8:
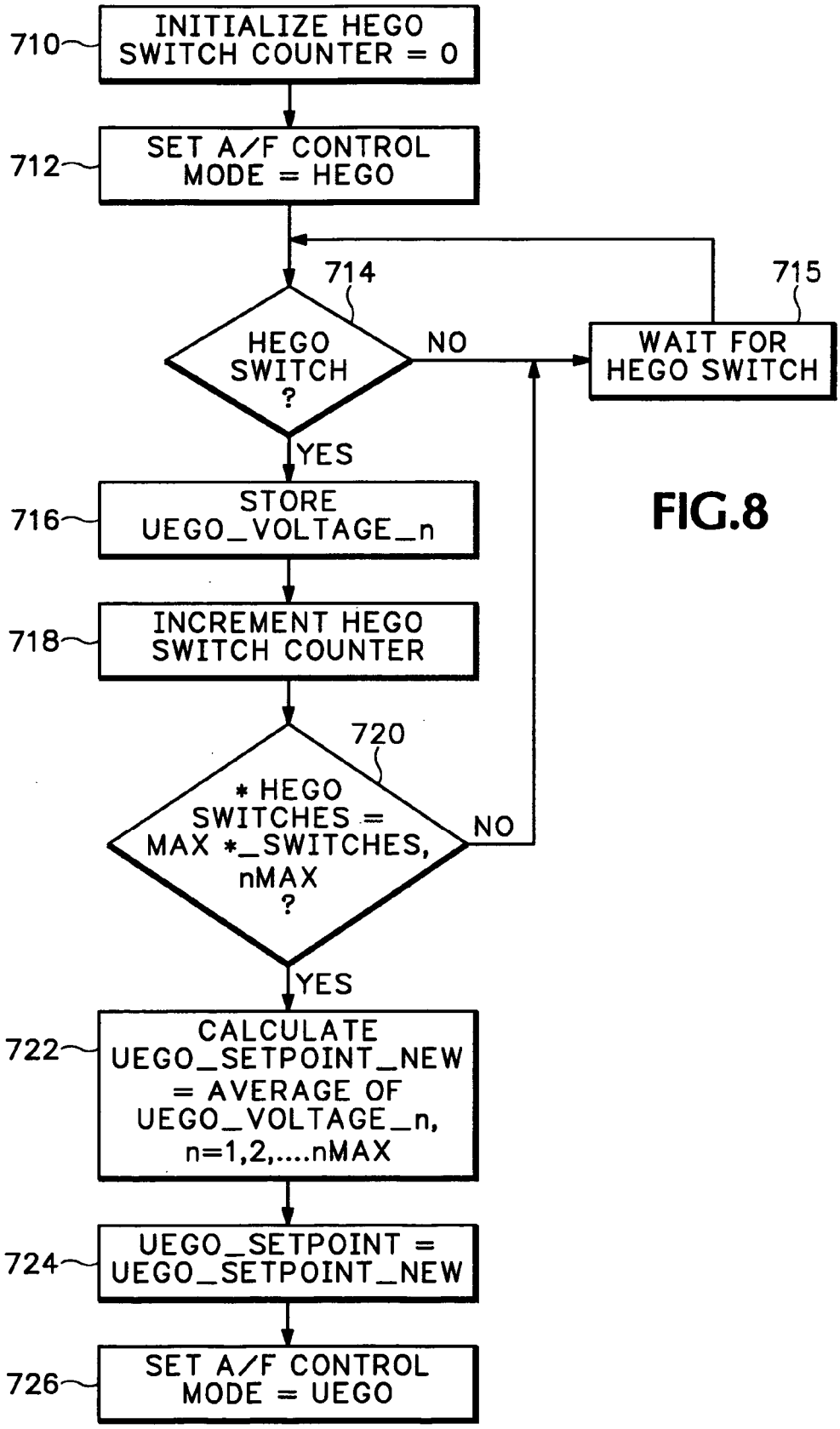
FIG. 8 is a flow chart describing the operation of a control system that uses the sensor and circuitry of the previous figures to advantage.

Referring now to FIG. 8, a method in which the disclosed circuit may be used to advantage is described. Note however that the method can be used with any appropriate circuit/sensor that provides both a UEGO type output and a HEGO type output, or some form of each output. The basic self-tuning algorithm is shown in FIG. 8 and described below.

In one embodiment, both pre- and post-catalyst sensors are combined UEGO-HEGO sensors. First, in step 710, a microprocessor variable (HEGO_Switch_Counter), used to count the number of times the exhaust air-fuel ratio traverses stoichiometry, is initialized to 0. A calibratible value (nmax) corresponds to the maximum number of times the stoichiometric value is to be tabulated.

The air-fuel ratio feedback control mode is then set in step 712 to use the switching output from the upstream sensor to regulate air-fuel ratio around the perceived stoichiometric value. In this case, the amount of fuel injected is adjusted based on feedback from the upstream sensor and a setpoint value. In this configuration, the switching signal from the sensor is fed back through a proportional plus integral feedback controller, so that the air-fuel ratio may cycle from rich to lean at a frequency and amplitude determined by the parameters of the controller. For example, the error between the adjusted setpoint and the sensor value can be multiplied by a proportional gain, and integrated and multiplied by an integral gain, and then summed. The summation is then applied to adjust the fuel injection signal.

Then, in steps 714 to 720, the routine measures and stores in microprocessor memory the value of the UEGO voltage determined by the circuit described in FIG. 5 for nmax excursions through stoichiometry. Specifically, in step 714, the routine determines whether a switch in the obtained HEGO signal has occurred (i.e., by measuring the difference between the air and exhaust gas electrodes in the UEGO sensor). In other words, the routine uses the modified signal from the sensor that is indicative of stoichiometry to identify whether the measured air-fuel ratio has crossed from lean to rich, or rich to lean, of stoichiometry. Alternatively, the sensor has two dedicated outputs (one for a UEGO type signal and the other for a HEGO type signal), then the routine monitors the HEGO signal for a switch. In another alternative, if a single sensor signal is used for both, the routine monitors for a HEGO switch under conditions (or commands) where the signal is indicative of a HEGO signal.

If not, the routine continues to step 715 to wait for such a switch, returning to step 714.

Alternatively, when a switch has been identified, the routine continues to step 716 to store the UEGO voltage at the switch point as (UEGO_Voltage_n). Then, in step 718, the routine increments the HEGO switch counter. Then, in step 720, the routine determines whether the number of HEGO switches (as indicated by the counter, for example) is greater than a calibratable maximum number of switches required (nmax).

Then, in steps 722 and 724, the upstream sensor setpoint is adjusted based on the average value of nmax measurements of the stoichiometric output voltage. Alternatively, the upstream sensor setpoint is adjusted based on the average value of nmax measurements of the stoichiometric output voltage adjusted by a calibratible bias. This setpoint for the upstream sensor is then compared with the upstream sensor signal to adjust fuel injection and thereby maintain exhaust air-fuel ratio to modulate about the stoichiometric air-fuel ratio with high accuracy.

Finally, in step 726, the air-fuel ratio feedback control mode is reset to use the output of the linear sensor and the new setpoint value as established by the steps above. In an alternative embodiment, the upstream sensor setpoint is adjusted based on the average value of nmax measurements of the stoichiometric output voltage and the average value of measurements of the stoichiometric output voltage previously stored in the microprocessor memory. Yet another alternative embodiment is to adjust the upstream sensor setpoint based on other statistical measures of the sampled stoichiometric output voltage. The measured stoichiometric output voltage may additionally be tabulated as a function of engine operating condition and stored in microprocessor memory.

This routine has provided a general approach, which can be modified depending on the type of sensor used in the upstream and downstream locations. To illustrate, the following example embodiments are described for specific system configurations.

In one embodiment, pre- and post-catalyst combined UEGO-HEGO Sensors are utilized. The following modifications can be made to the method for establishing the setpoint of upstream and downstream sensors corresponding to the post-catalyst perceived stoichiometric value.

First, microprocessor variable (HEGO_Switch_Counter), used to count the number of times the exhaust air-fuel ratio traverses stoichiometry is initialized to 0. The calibratible value (nmax) corresponds to the maximum number of times the stoichiometric value is to be tabulated.

Second, the air-fuel ratio feedback control mode is set to use the switching output from the upstream sensor to regulate air-fuel ratio around the perceived stoichiometric value. In this configuration, the switching signal from the sensor is fed back through a proportional plus integral feedback controller, so that the air-fuel ratio will cycle from rich to lean at a frequency and amplitude determined by the parameters of the controller.

Third, for nmax excursions through stoichiometry, the value of the post-catalyst UEGO voltage determined by the circuit described in FIG. 5 is measured and stored in microprocessor memory.

Fourth, the downstream sensor setpoint is adjusted based on the average value of nmax measurements of the stoichiometric output voltage. Alternatively, the downstream sensor setpoint is adjusted based on the average value of nmax measurements of the stoichiometric output voltage adjusted by a calibratible bias. Optionally, the upstream sensor setpoint is adjusted based on the average value of nmax measurements of the stoichiometric output voltage from the downstream sensor. Alternatively, the upstream sensor setpoint is adjusted based on the average value of nmax measurements of the stoichiometric output voltage adjusted by a calibratible bias.

Fifth, the air-fuel ratio feedback control mode is reset to use the output of the upstream linear sensor and the new setpoint value as established by the steps above.

In a second embodiment, a pre-catalyst UEGO and post-catalyst combined UEGO-HEGO Sensor are used. The following modifications can be made to the method for establishing the setpoint of upstream and downstream sensors corresponding to the post-catalyst perceived stoichiometric value.

First, microprocessor variable (HEGO_Switch_Counter), used to count the number of times the exhaust air-fuel ratio traverses stoichiometry, is initialized to 0. The calibratible value (nmax) corresponds to the maximum number of times the stoichiometric value is to be tabulated.

Second, the air-fuel ratio feedback control mode is set to a switching mode wherein the output of the linear sensor is input to a comparator with a reference voltage equal to the nominal setpoint voltage of the sensor. The resultant switching signal from the sensor is fed back through a proportional plus integral feedback controller, assuring that the air-fuel ratio will cycle from rich to lean at a frequency and amplitude determined by the parameters of the controller.

Third, for nmax excursions through stoichiometry, the value of the post-catalyst UEGO voltage determined by the circuit described in FIG. 5 is measured and stored in microprocessor memory.

Fourth, the downstream sensor setpoint is adjusted based on the average value of nmax measurements of the stoichiometric output voltage. Alternatively, the downstream sensor setpoint is adjusted based on the average value of nmax measurements of the stoichiometric output voltage adjusted by a calibratible bias.

Optionally, the upstream sensor setpoint is adjusted based on the average value of nmax measurements of the stoichiometric output voltage from the downstream sensor. Alternatively, the upstream sensor setpoint is adjusted based on the average value of nmax measurements of the stoichiometric output voltage adjusted by a calibratible bias.

Sixth, the air-fuel ratio feedback control mode is reset to use the output of the upstream linear sensor and the new setpoint value as established by steps above.

As described above with regard to the various embodiments, it is possible to obtain improved performance by using information from a downstream sensor indicative of both a substantially linear, and a substantially non-linear, air-fuel signal. In one example, this information is used to adjust a setpoint for feedback control using an upstream air-fuel sensor. In the case where the upstream sensor is a HEGO sensor, this provides for accurate control of engine air-fuel ratio, especially when operating away from stoichiometry since a substantially linear signal from the downstream sensor can be used. In the case where the upstream sensor is a UEGO sensor, this provides for accurate control of the catalyst at stoichiometry since it is possible to accurately maintain the exhaust gas in the catalyst about the stoichiometric value and maintain oxygen storage in the catalyst from being depleted, or stored past the maximum storage ability.

Various modifications to the self-tuning method of FIG. 8 can be envisioned. For example, additional entrance and exit logic can be added, so that the routine is performed under preselected operating conditions. Other methods of inducing HEGO switching for the purpose of identifying the stoichiometric point may be used, such as air injection in the exhaust ahead of the sensor, for example.

Furthermore, a sensor located behind an emission control device with a large amount of O2 storage may exhibit a low switching frequency. In an alternative embodiment, instead of forcing crossings near stoichiometry, the stoichiometric switch point may be inferred by deliberately operating the engine rich of stoichiometry (where the catalyst has been depleted of stored oxygen) or lean of stoichiometry (where the catalyst has been filled with stored oxygen) and tabulating excursions through the associated calibratible HEGO voltage such as HEGO=0.7 volts or 0.3 volts. A comparison of the tabulated linear output voltages for the rich and lean points may be used to infer changes at another point of interest, such as HEGO=0.6 volts.

The device and methods previously described can be further extended to the area of diagnosis. Specifically, the identified UEGO setpoint may be compared to a threshold value or a previously identified value. Based on the magnitude of the difference between measurements, a diagnostic warning light may be illuminated and a code written to the appropriate memory location of the control microprocessor.

This concludes the detailed description.

We claim:

1. A method for controlling fuel injection into an engine having an exhaust system with an emission control device located therein, the method comprising:

reading information from a downstream sensor coupled in said emission control system downstream of said emission control device, said information including a substantially linear indication of exhaust air-fuel ratio, said linear indication being substantially linear across an entire range of air-fuel ratios from at least 12:1 to 18:1, said information also including a substantially non-linear indication of stoichiometry;

adjusting a setpoint for an upstream sensor based on said information; and adjusting fuel injection into the engine based on said adjusted setpoint and a signal from said upstream sensor.

2. The method of claim 1 wherein said information is provided by a signal.

3. The method of claim 1 wherein said information from said downstream sensor includes said substantially linear indication under a first set of conditions, and includes said substantially non-linear indication of stoichiometry under a second set of conditions.

4. The method of claim 1 wherein said substantially non-linear indication is sampled from a signal providing said substantially linear indication at a preselected condition.

5. The method of claim 1 wherein said upstream sensor is a HEGO sensor.

6. The method of claim 1 wherein said upstream sensor is a UEGO sensor.

7. The method of claim 1 wherein said adjusting fuel injection into the engine further includes adjusting fuel injection into the engine based on an error between said adjusted setpoint and a signal from said upstream sensor.

8. The method of claim 1 wherein said adjusted setpoint is adjusted to be a stoichiometric value.

9. A method for controlling fuel injection into an engine having an exhaust system with an emission control device located therein, the method comprising:

reading information from a downstream sensor coupled in said emission control system downstream of said emission control device, said information including a substantially linear indication of exhaust air-fuel ratio, said linear indication being substantially linear across an entire range of air-fuel ratios from at least 12:1 to 18:1;

reading information from said sensor identifying a stoichiometric region, said information based on a measurement signal obtained from said sensor differently than a measurement signal used to produce said substantially linear indication;

adjusting a setpoint for an upstream sensor based on said signal; and adjusting fuel injection into the engine based on said adjusted setpoint and a signal from said upstream sensor.

10. The method of claim 9 wherein said stoichiometric region is a stoichiometric point.

11. The method of claim 9 wherein said adjusted setpoint is adjusted to be a stoichiometric value.

12. A system comprising:

a sensor generating a first signal providing a substantially linear indication of exhaust air-fuel ratio, said linear indication being substantially linear across an entire range of air-fuel ratios from at least 12:1 to 18:1 during a first set of conditions, and a second signal generating a substantially non-linear indication of exhaust air-fuel ratio during a second set of conditions; and a computer storage medium having instructions encoded therein for controlling fuel injection into an engine having an exhaust system with an emission control device located therein, said medium comprising:

code for reading said first and second signal from said sensor;

code for adjusting a setpoint, for a feedback controller for an sensor coupled upstream of said emission control device, based on said first and second signals; and code for adjusting fuel injection into the engine based on said adjusted setpoint and a signal from said upstream sensor.

13. The system of claim 12 wherein first signal and second signal are provided via an electronic circuit coupled to said sensor, and wherein said emission control device is located upstream of said sensor.

14. The system of claim 12 wherein said second signal is sampled from said first signal during said second set of operating conditions.

15. The system of claim 12 wherein said upstream sensor is a HEGO sensor.

16. The system of claim 12 wherein said upstream sensor is a UEGO sensor.

17. The system of claim 12 wherein said code for adjusting fuel injection into the engine further includes code for adjusting fuel injection into the engine based on an error between said adjusted setpoint and a signal from said upstream sensor.

18. The system of claim 17 wherein said adjusted setpoint is adjusted to be a stoichiometric value.

* * * * *